United States Patent [19]

Durand-Texte

[11] Patent Number: 4,957,154

[45] Date of Patent: Sep. 18, 1990

[54] PROCESS FOR THE IN-LINE HOMOGENIZATION AND RECRYSTALLIZATION OF METALLIC PRODUCTS OBTAINED BY CONTINUOUS CASTING

[75] Inventor: Gérard Durand-Texte, Aubervilliers, France

[73] Assignee: Establissments Griset, Aubervilliers, France

[21] Appl. No.: 348,816

[22] Filed: May 8, 1989

[30] Foreign Application Priority Data

Jun. 3, 1988 [FR] France ..... 88 07432

[51] Int. Cl.[5] ..... B22D 11/12

[52] U.S. Cl. ..... 164/476; 164/477; 29/527.7; 148/2

[58] Field of Search ..... 164/417, 476, 477; 29/527.7; 148/2

[56] References Cited

U.S. PATENT DOCUMENTS 4,021,271 5/1977 Roberts ..... 148/2
4,151,896 5/1979 Nicoud et al. ..... 148/2
4,422,884 12/1983 Vickers et al. ..... 148/2
4,709,572 12/1987 Yamada et al. ..... 29/527.7

FOREIGN PATENT DOCUMENTS 0170254 2/1986 European Pat. Off. ..... 164/476
59-96219 6/1984 Japan ..... 164/477
61-27151 2/1986 Japan ..... 164/476

*Primary Examiner*—Richard K. Seidel
*Attorney, Agent, or Firm*—Woodcock Washburn Kurtz Mackiewicz & Norris

[57] ABSTRACT

A method for the in-line homogenization and recrystallization of a continuous casting product by providing a continuous casting product including an alloy having a plurality of phases therein disposed proximate to the surface of the product and forming a plurality of voids at least near the surface by superficially cold-working the product. The surface is homogenized by heat treating and substantially reducing at least one of the phases whereby a portion of the voids assist in accelerating the diffusion of a portion of the voids into the alloy.

3 Claims, 1 Drawing Sheet

PROCESS FOR THE IN-LINE HOMOGENIZATION AND RECRYSTALLIZATION OF METALLIC PRODUCTS OBTAINED BY CONTINUOUS CASTING

FIELD OF THE INVENTION

The present invention relates to a process and an installation for the in-line homogenization and recrystallization of metallic products obtained by continuous casting.

BACKGROUND OF THE INVENTION

The invention relates, in particular, to products such as metallic strips or sections and, in particular, in the form of an alloy.

This applies in particular to tin bronze which, as cast, contains, in addition to the solid solution $\alpha$, the phases $\beta$ and *.

Various processes exist for homogenizing and recrystallizing tin bronze.

The most commonly used process consists in placing the metal coils, which are as cast, in an in-and-out furnace and bringing their temperature to about 700° C. over a period sufficiently long to ensure that no point of the metal exceeds certain critical temperatures (remelting of phases) and in maintaining this temperature for a sufficiently long time to ensure that the phases to be eliminated have disappeared: this cycle is very long: twenty-four hours for example.

It is likewise known that the metal as cast can be cold-worked in order to reduce the treatment time and improve homogenization. This cold-working ffects the whole of the cast product and is reflected in a significant reduction in thickness, reducing for example a strip of 15 millimeters to 10 millimeters.

By virtue of the cold working, the treatment time is reduced but the rolling which accomplishes the cold working of the metal and the roll bending for coiling the product increase the risk of creating defects in the metal since the phases which are still present in the metal and which it is the intention to eliminate by the homogenization treatment increase the brittleness of the metal.

The two processes above are discontinuous processes since the installation used to carry out the homogenization is not placed in line with the casting installation.

There is a third process for carrying out an in-line homogenization. Thus the product does not pass into a furnace in the form of a coil but in the flat. For this, a furnace of a certain length placed directly at the outlet of the continuous casting installation is required. The disadvantage of this process is that it results in considerable furnace lengths; the advantage is that this process avoids cold shut and reduces the risk of creating roll bending defects since the roll bending of the products, for example to coil them, is not carried out until after the treatment, when the product is sufficiently homogeneous.

In conclusion, none of the above processes permits appreciable modification of the crystallographic structure of the alloy, which remains a structure as cast.

SUMMARY OF THE INVENTION

The object of the present invention is to create a process for the in-line homogenization and recrystallization of products produced by continuous casting, particularly in the form of strips or sections, and in particular products in the form of alloys, for example of tin bronze, obtained by continuous casting, to bring about a perfect homogenization of the metal and obtain a complete recrystallization corresponding to a fine-grained homogeneous structure.

To this end, the invention relates to a homogenization and recrystallization process characterized in that:

superficial cold working is carried out on the product, the product superficially cold-worked in this way is subjected to a heat treatment.

According to another characteristic of the invention, the heat treatment is effected in line.

According to another characteristic of the invention, the in-line heat treatment comprises applying a predetermined temperature profile to the product.

The invention likewise relates to an installation for implementing the process, this installation being characterized in that it comprises a superficial cold-working station receiving the product emerging from continuous casting in order to carry out superficial cold working there and an in-line heat treatment station through which the superficially cold-worked product passes in order to undergo a heat treatment there in the course of its passage through this station, as well as a regulation and control means for regulating the temperature profile inside the heat treatment station.

According to another characteristic of the invention, the cold-working station consists of a pendulum or cam-type roll mill, a roll mill incorporating shot peening, or a hydraulic press.

BRIEF DESCRIPTION OF THE DRAWINGS

The present invention will be described in greater detail with the aid of an exemplary embodiment of the process and of an installation which are represented in the attached drawings, in which.

DETAILED DESCRIPTION OF THE INVENTION

Figure 1:
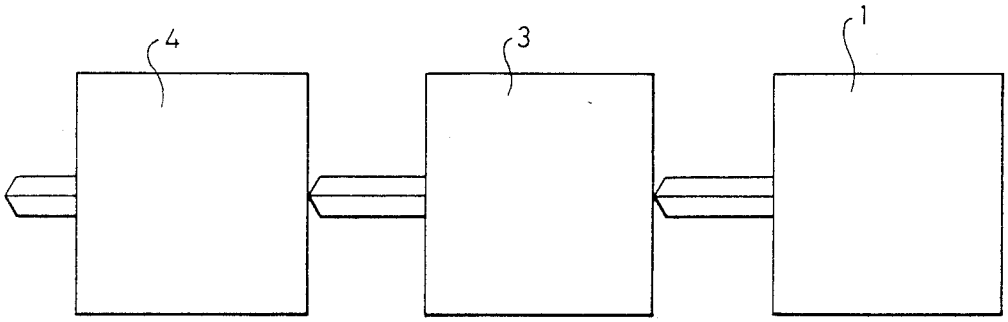
FIG. 1 is a flow chart of the process of the invention.

According to FIG. 1, the in-line homogenization and recrystallization process comprises manufacturing a metallic product, particularly a product in the form of an alloy such as a strip or a section, in particular in the form of a copper alloy, by continuous casting 1, then passing this product in-line through appropriate transfer means in order to make it undergo superficial cold-working 3; after the cold working, the product is subjected to a heat treatment 4. This heat treatment carried out in-line on the product conforms to a predetermined temperature profile. This heat treatment immediately follows the superficial cold-working operation. This superficial cold working may be effected by rolling over a narrow width with the aid of rolling elements carrying out movements perpendicular to the axis of the product. By way of example, for a product in the form of a strip having a thickness of 15 millimeters, the cold working results in a reduction in thickness of 0.4 millimeters. This cold working puts the faces of the product or of the strip under compression. This cold working is all the more pronounced in that it takes place near to the surface of the product. Now the undesirable phases are situated at the surface of the product.

Since this superficial cold working gives rise to voids in the metal of the product, this will considerably increase the diffusion rate while at the same time prompting the recrystallization of the metal during the heating. It is appropriate to emphasize that since the cold working takes place at the surface, the heart of the product is not cold-worked, this avoiding all risk of causing defects.

The heat treatment 4 carried out in line permits the metal to be brought to a temperature directly below the melting point of one phase in a very short time, of the order of a few minutes, thus avoiding spoiling the metal. A temperature of 700° C., for example, will be chosen for bronze.

As indicated above, the superficial cold working phase speeds up diffusion considerably and makes it possible to come very close to the critical temperature since the actual temperature of the metal is known, in contrast to the known processes consisting in the use of an in-and-out furnace.

It is appropriate to emphasize that the diffusion rate is an exponential function of the temperature and that a gain of 30° C. justified by the knowledge of the actual temperature of the metal, makes it possible to double the diffusion rate. Thus, the invention makes it possible to combine the effect of the cold working of the metal and of a heat treatment at a higher temperature. By way of example, the heat treatment could be carried out at 800° C. for a copper alloy containing 8% of Sn and at 840° C. for a copper alloy containing 6% of Sn. This heat treatment brings about all the phase transitions in the controlled times reduced to a minimum. The cold working brings about the complete recrystallization of the treated metal and this recrystallization itself is favoured by the phase transitions engendered by the elevated temperatures at which the heat treatment can be carried out.

Depending on the alloys to be treated, a temperature law or profile of the product is established as a function of time; such a temperature profile may be composed of a part in which the temperature rises, a plateau during which the temperature is maintained at a certain level, a possible renewed rise in temperature followed by a plateau etc. . . . This makes it possible to bring about successive optimum phase changes in times reduced to a minimum. These phases are thus made to disappear completely and the recrystallization of the metal is brought about.

Figure 2:
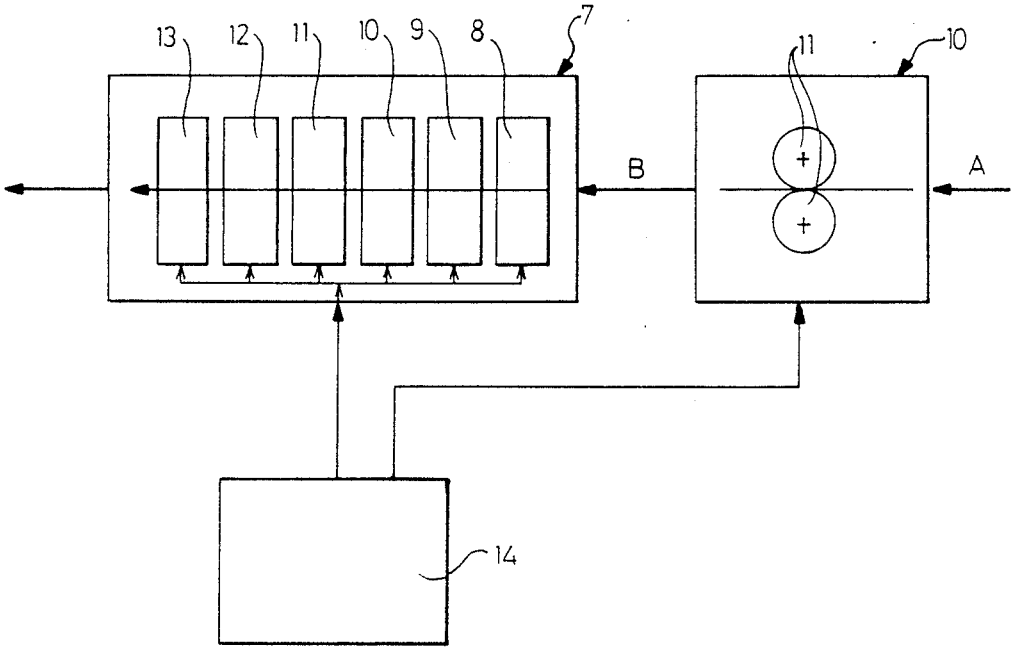
FIG. 2 is a flow chart of an installation for implementing the process.

FIG. 2 is a flow chart of an installation for implementing this process. This installation comprises a cold-working station 10 represented schematically by two rolls 11. The product arrives in the cold-working station 10 in-line in accordance with the arrow A, emerges from it in accordance with the arrow B and passes through the heat treatment station 7 in-line, said heat treatment station comprising, for example, a furnace in which a plurality of zones 8–13 at different temperatures are defined. The installation likewise comprises a means of regulation and control 14 which senses and manages the cold-working station 10 as well as the heat treatment station 7.

The cold-working station 10 can comprise a pendulum or cam-type roll mill or a shot peening station or a hydraulic press effecting the superficial cold working.

The heat treatment station 7 comprises a furnace. Since the diffusion rate in the product to be treated is accelerated by virtue of the process of the invention, this makes it possible to reduce to the minimum the length of the heat treatment station 7 passed through by the in-line product.

I claim:

1. A process for the in-line homogenization and recrystallization of a continuous casting product, comprising:

(a) providing a continuous casting product including an alloy having a plurality of phases therein disposed proximate to the surface of said product;

(b) forming a plurality of voids at least near said surface by superficially cold-working said product; and (c) homogenizing at least said surface by heat treating said product, and substantially reducing at least one of said phases whereby a portion of said voids assist in accelerating a diffusion of a portion of said phases into said alloy.

2. The process according to claim 1, characterized in that said heat treating step is carried out in-line.

3. The process according to claim 2, characterized in that said heat treating step comprises applying a predetermined temperature profile to the product.

* * * * *